US009232296B2

(12) United States Patent
Gudiksen

(10) Patent No.: US 9,232,296 B2
(45) Date of Patent: Jan. 5, 2016

(54) METHOD AND APPARATUS FOR TRANSMITTING WIRELESS AUDIO STREAMS

(71) Applicant: GN ReSound A/S, Ballerup (DK)

(72) Inventor: Ole Gudiksen, Farum (DK)

(73) Assignee: GN RESOUND A/S, Ballerup (DK)

( * ) Notice: Subject to any disclaimer, the term of this patent is extended or adjusted under 35 U.S.C. 154(b) by 36 days.

(21) Appl. No.: 13/899,228

(22) Filed: May 21, 2013

(65) Prior Publication Data

US 2014/0341390 A1 Nov. 20, 2014

(30) Foreign Application Priority Data

May 15, 2013 (DK) ..... 2013 70263
May 15, 2013 (EP) ..... 13167809

(51) Int. Cl.
*H04H 20/71* (2008.01)
*H04R 1/10* (2006.01)
*H04R 27/00* (2006.01)

(52) U.S. Cl.
CPC ..... *H04R 1/1091* (2013.01); *H04R 27/00* (2013.01); *H04R 2227/003* (2013.01); *H04R 2420/07* (2013.01); *H04R 2460/03* (2013.01)

(58) Field of Classification Search
CPC ..... H04R 1/1091
USPC ..... 455/3.01, 454, 67.14, 67.11
See application file for complete search history.

(56) References Cited

U.S. PATENT DOCUMENTS

| | | | | |
|---|---|---|---|---|
| 7,454,683 | B2 | 11/2008 | Vesma et al. | |
| 2007/0008969 | A1 | 1/2007 | Elstermann et al. | |
| 2008/0089270 | A1 * | 4/2008 | Norris et al. | 370/319 |
| 2011/0075637 | A1 * | 3/2011 | Wu et al. | 370/336 |
| 2012/0260295 | A1 | 10/2012 | Rondeau | |
| 2013/0042291 | A1 | 2/2013 | Kambhatla | |
| 2013/0243205 | A1 * | 9/2013 | Wang | 381/56 |

FOREIGN PATENT DOCUMENTS

| | | | |
|---|---|---|---|
| EP | 2015603 | A1 | 1/2009 |
| GB | 2 463 277 | A | 3/2010 |
| JP | H11-234241 | A | 8/1999 |
| WO | 2004/110099 | A2 | 12/2004 |
| WO | WO 2006/110445 | A1 | 10/2006 |

(Continued)

OTHER PUBLICATIONS

Notification of Reasons for Rejection dated Sep. 16, 2014 for related Japanese Patent Application No. 2014-100759, 6 pages.

(Continued)

*Primary Examiner* — Sanh Phu
(74) *Attorney, Agent, or Firm* — Vista IP Law Group, LLP

(57) ABSTRACT

A method for transmitting wireless audio streams in an audio system comprising a first transmitter unit, the method includes: transmitting a first audio block in a first audio frame, the first audio block comprising a first primary audio package having a transmitter unit address of the first transmitter unit; transmitting a first primary pilot package, the first primary pilot package comprising the transmitter unit address of the first transmitter unit, a first primary time offset, and a channel identifier of a first primary audio package of a second audio block in a second audio frame; and transmitting the first primary audio package of the second audio block at a start time depending on the first primary time offset and the channel identifier.

19 Claims, 6 Drawing Sheets

(56) References Cited

FOREIGN PATENT DOCUMENTS

| | | | |
|---|---|---|---|
| WO | WO 2009/062115 | A2 | 5/2009 |
| WO | 2012/049311 | A1 | 4/2012 |

OTHER PUBLICATIONS

First Technical Examination and Search Report dated Aug. 26, 2013 for related Danish Patent Applcation No. PA 2013 70263, 4 pages.

Extended European Search Report dated Oct. 24, 2013 for related European Patent Application No. 13167809.6, 9 pages.

Jennifer Groth et al., "How user requirements affect technology choice for wireless hearing instruments", Dec. 31, 2010, 5 pages.

Second Technical Examination (Intention to Grant) dated Mar. 14, 2014 for related Danish Patent Application No. PA 2013 70263, 2 pages.

* cited by examiner

| |
|---|
| TRANSMITTER UNIT ADDRESS |
| AUDIO STREAM IDENTIFIER |
| AUDIO STREAM DATA |

Fig. 6

| |
|---|
| TRANSMITTER UNIT ADDRESS |
| CHANNEL IDENTIFIER |
| TIME OFFSET |
| AUDIO STREAM IDENTIFIER |
| NETWORK IDENTIFIER |

Fig. 7

METHOD AND APPARATUS FOR TRANSMITTING WIRELESS AUDIO STREAMS

RELATED APPLICATION DATA

This application claims priority to, and the benefit of, Danish Patent Application No. PA 2013 70263, filed on May 15, 2013, and European Patent Application No. 13167809.6, filed on May 15, 2013. The disclosures of both of the above applications are expressly incorporated by reference in their entireties herein.

FIELD

The present disclosure relates to an audio system for audio streaming and associated method. More specifically, the present disclosure describes a method and audio system for transmitting wireless audio streams, in particular to hearing device(s).

BACKGROUND

Wireless communication to and from hearing devices has been increasing in continuation of the developments within wireless communication technology. In a crowded environment where audio is distributed to the crowd, for example in an airport or in a movie theatre, it is known to stream audio via a telecoil solution having a limited bandwidth with limited possibilities of separating different audio streams.

Digital solutions of audio streaming have enhanced possibilities for broadcasting audio. However, the range of a single transmitter unit transmitting an audio stream is limited, thus there is a need for a method that allows reception of the same audio stream from different transmitter units.

The limited battery power of hearing devices however requires ways of minimizing data transmission from the hearing device, in an effort to prolong battery life. Hence the shift from receiving the audio stream from one transmitter unit to receiving the same audio stream from an alternative transmitter unit, demands that the transmission of data from the hearing device is eliminated or seriously minimized.

Thus, there is a need for an audio system that provides audio streaming to a moving user, without relying on transmission of data back and forth between the audio system and the hearing device during handover between a first and second transmitter unit.

SUMMARY

Accordingly, a method for transmitting wireless audio streams in an audio system comprising a first transmitter unit is provided. The method comprises transmitting a first audio block in a first audio frame, e.g. with the first transmitter unit. The first audio block comprises at least one audio package including a first primary audio package, and the first primary audio package comprises transmitter unit address of the first transmitter unit. The method further comprises transmitting a first primary pilot package, e.g. with the first transmitter unit. The first primary pilot package comprises transmitter unit address of the first transmitter unit, a first primary time offset, and channel identifier of an audio package, e.g. a first primary audio package, of a second and/or other subsequent audio block in a second and/or other subsequent audio frame. Further, the method comprises transmitting an audio package, e.g. the first primary audio package, of the second audio block at a start time depending on or according to the first primary time offset and the channel identifier.

Also disclosed is an electromagnetic signal comprising a plurality of audio blocks including a first audio block in a first audio frame and a second audio block in a second audio frame following the first audio frame. The first audio block and the second audio block each comprises one or more audio packages including a first primary audio package. The electromagnetic signal comprises a first primary pilot package in the first audio frame. The first primary pilot package and the first primary audio package of the second audio block are separated by a first primary time offset. The first primary pilot package comprises transmitter unit address, the first primary time offset, and channel identifier of the first primary audio package of the second audio block.

Also disclosed is an audio system for transmitting wireless audio streams. The audio system comprises one or more transmitter units including a first transmitter unit, the one or more transmitter units being configured for transmitting audio blocks. Each audio block includes one or more audio packages including a first primary audio package. The first primary audio package comprises transmitter unit address of the respective transmitter. The first transmitter unit is configured to transmit a first audio block in a first audio frame. The first audio block comprises a first primary audio package, and the first primary audio package comprises transmitter unit address of the first transmitter unit. The first transmitter unit is further configured to transmit a first primary pilot package. The first primary pilot package comprises transmitter unit address of the first transmitter unit, a first primary time offset, and channel identifier of a first primary audio package of a second audio block in a second audio frame. The first transmitter unit is further configured to transmit the first primary audio package of the second audio block at a start time depending on the first primary time offset and the channel identifier of the first primary audio package of the second audio block.

Also disclosed is a transmitter unit for transmitting wireless audio streams, wherein the transmitter unit is configured for transmitting an electromagnetic signal as described herein.

While receiving at a hearing device an audio stream from a transmitter unit, the user of the hearing device may move away from the transmitter unit or something may interfere with the signal, thus causing the signal strength to decrease. Eventually this may lead to total loss of the signal and failure to receive the audio stream. Enabling the hearing device to switch to, and receive the audio stream, from an alternative transmitter unit, may be provided by transmitting pilot packages from the transmitter units.

Receiving, at a hearing device, pilot packages from other transmitter units transmitting the same audio stream as the hearing device is already receiving, provides an ability to seamlessly switch to receiving the audio stream from an alternative transmitter unit from the beginning of a subsequent such as the following or next audio frame. This is achieved by transmitting pilot packages comprising information of what channel to receive the first audio package of a subsequent such as the following or next audio block, when to receive it, and which transmitter unit to receive it from.

Thereby the need for transmitting data from the hearing device is eliminated or at least reduced, thus reducing power consumption and enhancing battery life of the hearing device. Further, it enables shift to receiving from an alternative transmitter unit to be performed without loss of data.

It is an advantage that simple switching between different transmitter units is provided.

Further, provision of a primary pilot package enables simpler and less power-consuming handover.

A method for transmitting wireless audio streams in an audio system comprising a first transmitter unit, the method includes: transmitting a first audio block in a first audio frame, the first audio block comprising a first primary audio package having a transmitter unit address of the first transmitter unit; transmitting a first primary pilot package, the first primary pilot package comprising the transmitter unit address of the first transmitter unit, a first primary time offset, and a channel identifier of a first primary audio package of a second audio block in a second audio frame; and transmitting the first primary audio package of the second audio block at a start time depending on the first primary time offset and the channel identifier.

Optionally, the method further includes transmitting a first secondary pilot package, the first secondary pilot package comprising the transmitter unit address of the first transmitter unit, a first secondary time offset, and the channel identifier of the first primary audio package of the second audio block, the secondary time offset being indicative of a time offset between the first secondary pilot package and the first primary audio package of the second audio block.

Optionally, the method further includes selecting the first secondary time offset based on a predetermined offset scheme, a random offset scheme, or a pseudo-random offset scheme.

Optionally, a time difference between the first primary pilot package and the first secondary pilot package is larger than a first time threshold.

Optionally, the first audio block further comprises a second primary audio package having the transmitter unit address of the first transmitter unit.

Optionally, the first primary pilot package comprises an audio stream identifier.

A transmitter unit for transmitting wireless audio streams, wherein the transmitter unit is configured for transmitting an electromagnetic signal comprising a plurality of audio blocks including a first audio block in a first audio frame and a second audio block in a second audio frame following the first audio frame, each of the first audio block and the second audio block comprising a first primary audio package, the electromagnetic signal comprising a first primary pilot package in the first audio frame, wherein the first primary pilot package and the first primary audio package of the second audio block is separated by a first primary time offset, and wherein the first primary pilot package comprises a transmitter unit address, the first primary time offset, and a channel identifier of the first primary audio package of the second audio block.

Optionally, the electromagnetic signal comprises a first secondary pilot package in the first audio frame, the first secondary pilot package and the first primary audio package of the second audio block being separated by a first secondary time offset, wherein the first secondary pilot package comprises the transmitter unit address, the first secondary time offset, and the channel identifier of the first primary audio package of the second audio block.

Optionally, a time difference between the first primary pilot package and the first secondary pilot package is larger than a first time threshold.

Optionally, the first audio block comprises a second primary audio package having the transmitter unit address.

Optionally, the first primary pilot package comprises an audio stream identifier.

An audio system for transmitting wireless audio streams includes one or more transmitter units including a first transmitter unit, the one or more transmitter units being configured for transmitting audio blocks, each of at least two of the audio blocks including a first primary audio package comprising a transmitter unit address, wherein the first transmitter unit is configured to transmit a first audio block in a first audio frame, the first audio block comprising a first primary audio package comprising a transmitter unit address of the first transmitter unit; transmit a first primary pilot package, the first primary pilot package comprising the transmitter unit address of the first transmitter unit, a first primary time offset, and a channel identifier of a first primary audio package of a second audio block in a second audio frame; and transmit the first primary audio package of the second audio block at a start time depending on the first primary time offset and the channel identifier of the first primary audio package of the second audio block.

Optionally, the one or more transmitter units comprise a second transmitter unit, and wherein the second transmitter unit is configured to transmit a first audio block in a first audio frame, the first audio block transmitted by the second transmitter unit comprising a first primary audio package having a transmitter unit address of the second transmitter unit; transmit a first primary pilot package, the first primary pilot package transmitted by the second transmitter unit comprising the transmitter unit address of the second transmitter unit, a first primary time offset, and a channel identifier of a first primary audio package of a second audio block in a second audio frame; and transmit the first primary audio package of the second audio block from the second transmitter at a start time depending on the first primary time offset and the channel identifier of the first primary audio package of the second audio block from the second transmitter.

An audio system for transmitting wireless audio streams includes a first transmitter unit configured for transmitting audio blocks, wherein the first transmitter unit is configured to: transmit a first audio block in a first audio frame, the first audio block comprising a first primary audio package having a transmitter unit address of the first transmitter unit; transmit a first primary pilot package, the first primary pilot package comprising the transmitter unit address of the first transmitter unit, a first primary time offset, and a channel identifier of a first primary audio package of a second audio block in a second audio frame; and transmit the first primary audio package of the second audio block at a start time depending on the first primary time offset and the channel identifier.

Optionally, the first transmitter is further configured to transmit a first secondary pilot package, the first secondary pilot package comprising the transmitter unit address of the first transmitter unit, a first secondary time offset, and the channel identifier of the first primary audio package of the second audio block, the secondary time offset being indicative of a time offset between the first secondary pilot package and the first primary audio package of the second audio block.

Optionally, the system is configured for selecting the first secondary time offset based on a predetermined offset scheme, a random offset scheme, or a pseudo-random offset scheme.

Optionally, a time difference between the first primary pilot package and the first secondary pilot package is larger than a first time threshold.

Optionally, the first audio block further comprises a second primary audio package having the transmitter unit address of the first transmitter unit.

Optionally, the first primary pilot package comprises an audio stream identifier.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting to the scope of the claims.

DETAILED DESCRIPTION

Figure 1:
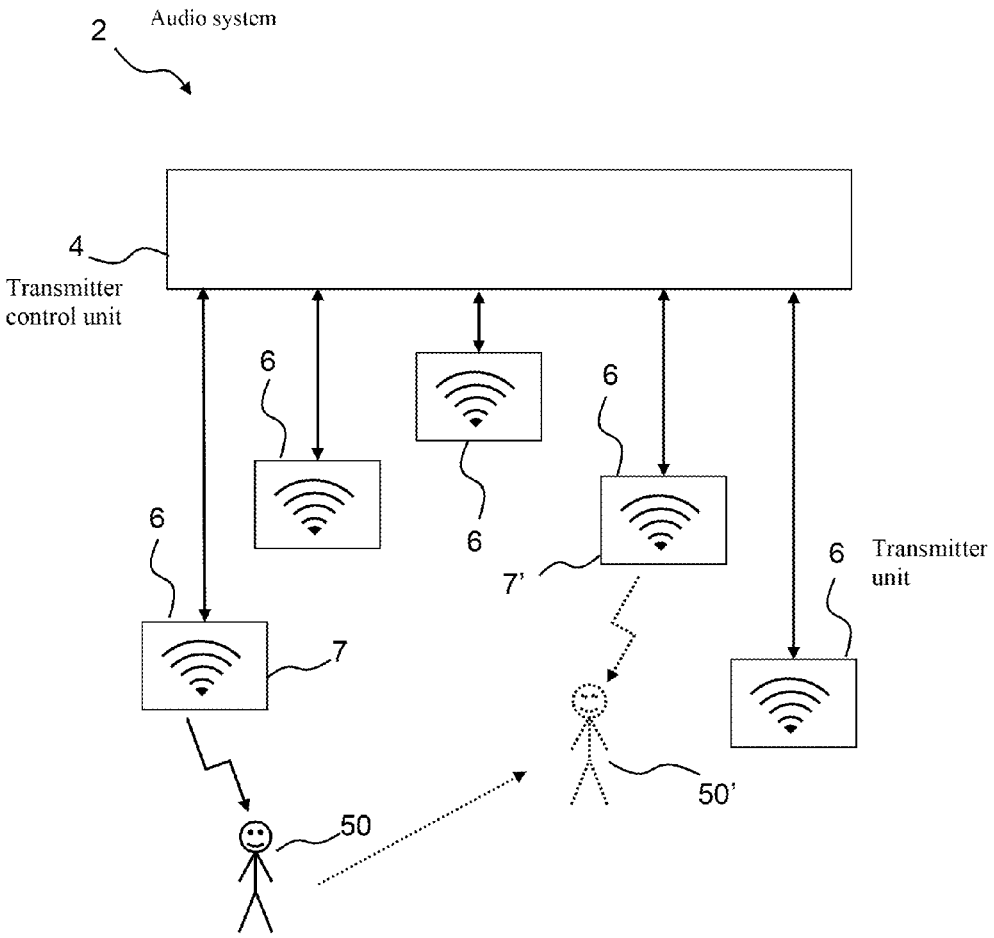
FIG. 1 schematically illustrates use of an exemplary audio system.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to a method and an audio system capable of transmitting or streaming audio stream(s) representing audio track(s) to hearing devices.

In an audio system, one or more transmitter units are configured for broadcasting or transmitting an audio stream, e.g. to one or more hearing devices. A transmitter unit may transmit one or more audio streams. A transmitter unit is identified by a transmitter unit address.

An audio track is an audible signal. Exemplary audible signals are an airport call, a movie sound track, speech or a piece of music.

An audio stream is an electromagnetic signal representative of an audio track. An audio stream is represented by a number of audio blocks each comprising one or more audio packages. An audio package comprises a finite part of an audio stream. Further explanation of an audio stream can be found in FIG. 3 and the accompanying description.

An audio block comprises one or more audio packages. An audio block may comprise one or more primary audio packages and/or one or more secondary audio packages. A secondary audio package may constitute a copy of a primary audio package allowing a hearing device to recover lost packages. Further, an audio block may comprise first audio packages and/or second audio packages for example constituting audio stream data for a left or a right ear, respectively. An audio block may comprise a first primary audio package and/or a second primary audio package. Further, a first secondary audio package and/or a second secondary audio package may be included in the audio block(s). Sending the same audio data in two or more audio packages provides improved quality of sound at the receiver. Further explanation of audio blocks and audio packages can be found in FIG. 4 and the accompanying description.

An audio stream comprises a number of pilot packages. A pilot package comprises information about a subsequent such as the following or next audio block.

An audio frame comprises an audio block with one or more audio packages, and optionally one or more pilot packages including a primary and/or a secondary pilot package. An audio frame may comprise a tertiary pilot package to further improve handover between transmitter units. An audio block may have a length between 0.240 ms and 8.0 ms, such as in the range from 0.380 ms to 6.8 ms, such as in the range from 2.0 ms to 3.5 ms, e.g. 2.85 ms. An illustrative example of an audio frame can be found in FIG. 3 and the accompanying description.

An audio stream may comprise an audio stream identifier, which may comprise one or more elements such as audio track identification, transmitter unit address, audio group identification etc. Audio track identification may enable selection of audio streams representative of the same audio track, and audio group identification may identify a certain group of audio tracks or audio streams e.g. an audio group may be audio tracks in the same or similar language, e.g. English, Danish or Chinese.

An audio package may comprise transmitter unit address of the transmitter unit transmitting the audio package, thus enabling the hearing device to sort out audio packages sent from other transmitter units.

A pilot package may comprise information enabling receipt of a subsequent such as the following or next audio block from the transmitter unit sending the audio stream in question. A pilot package comprises one or more time offsets indicative of timing between packages and/or audio blocks in the audio stream. Further, a pilot package may comprise a channel identifier. A channel identifier indicates the channel of audio package(s) in a subsequent such as the following audio block. Even further, a pilot package may comprise transmitter unit address and/or audio stream identifier. A pilot package may comprise network identifier or other data indicative of a group of transmitter units, thereby enabling a hearing device to select or limit searching for pilot packages of a group of transmitter units. A pilot package from a transmitter unit enables a hearing device to receive a subsequent such as the following audio block from the transmitter unit in question by configuring the hearing device in accordance with information comprised within the received pilot package. A primary pilot package in an audio block may comprise transmitter unit address, a primary time offset, and channel identifier of the first primary audio package of a subsequent such as the following audio block. A secondary pilot package in an audio block may comprise transmitter unit address, a secondary time offset, and channel identifier of the first primary audio package of a subsequent such as the following audio block.

A time offset comprised within the pilot package may indicate the time of transmittal of a subsequent such as the following audio block. The time offset may e.g. be the time from start of transmission of the pilot package to the time of start of transmission of the following audio block and/or to the time of start of transmission of an audio package in the following audio block. An illustrative example of the time offset can be found in FIG. 3 and the accompanying description.

The channel identifier comprised within the pilot package, may be indicative of the channel where a subsequent such as the following audio block is transmitted. A channel may be a known frequency.

The transmitter unit address comprised within the pilot package may be transmitter unit address of the transmitter unit from where the pilot package was transmitted, thus enabling the hearing device to identify the transmitter unit from where it may receive following audio packages corresponding to the pilot package in question.

An audio frame may have a time duration or period length T. T may be defined as being from start of transmission of an audio block to the start of transmission of the following audio block. T may be defined as being the time from start of transmission of the first primary audio package of the first audio block to the start of transmission of the first primary audio package of the second audio block. The period length T may be fixed e.g. be a time of between 2 ms and 20 ms, such as between 5 ms and 12 ms or such as between 6 ms and 10.2 ms, or between 6 ms and 6.5 ms, or between 7.2 ms and 7.7 ms, or between 9.8 ms and 10.2 ms. A long period length T may be beneficial for providing increased possibility of power saving in a hearing device, as a long period length T provides for a long duration where the receiver may be switched off. However, a long T leads to an increased latency, meaning that a long T is not sufficient if the audio needs to be synchronized with e.g. a movie. Hence a short T is beneficial if the audio is to be synchronized with another input, or is to be happening as close to real time as possible.

The audio system may comprise a first transmitter unit and optionally a second transmitter unit or optionally any number of a plurality of transmitter units. See e.g. transmitter units of FIG. 1 for an illustrative example of an audio system comprising a plurality of transmitter units.

Transmitting and receiving the wireless audio stream may be achieved by using wireless technology, thus transmitting audio blocks at one or more frequencies, e.g. in the range from 2.4 GHz to 2.5 GHz, in the range from 800 MHz to 1 GHz, in the range from 3.6 GHz to 3.7 GHz, and/or in the range from 4.9 GHz to 5.9 GHz.

A pilot package is sent on a pilot channel. Pilot packages may be transmitted on pilot channels selected from one or more available channels. The pilot channel for a pilot package may be selected from a subset of available channels, thus further reducing load on the hearing device during search for available transmitter units, by allowing the hearing device to only need to listen for pilot packages of alternative transmitter units at known channel(s). The channel(s) for pilot packages may be at one or more frequencies, e.g. in the range from 2.4 GHz to 2.5 GHz, in the range from 800 MHz to 1 GHz, in the range from 3.6 GHz to 3.7 GHz, and/or in the range from 4.9 GHz to 5.9 GHz.

Pilot package(s) may be transmitted in the same frequency range as audio blocks. Alternatively, pilot packages may be transmitted in a different frequency range than audio blocks and/or by using a different modulation scheme.

Transmission of pilot packages may be performed using a frequency hopping scheme, i.e. the pilot channel may be selected according to a frequency hopping scheme between three or more channels. The frequency hopping scheme may be random or pseudo-random or predetermined.

The method for transmitting wireless audio streams may comprise transmitting a first secondary pilot package, e.g. in the first audio frame. The first secondary pilot package may comprise transmitter unit address of the first transmitter unit, i.e. the transmitter unit from where it was transmitted, a first secondary time offset, and/or channel identifier of an audio package, such as the first primary audio package, of the second audio block. Provision of a secondary pilot channel enables faster switching between transmitter units, which leads to improved sound quality experienced by a moving user.

The first secondary time offset may be indicative of time offset between the first secondary pilot package and an audio package, e.g. the first primary audio package, of the second audio block.

Transmission of a secondary pilot package enhances the possibility of a hearing device listening to another transmitter unit to be able to receive a pilot package, since either one may be transmitted concurrently with the audio blocks sent from the other transmitter, or at a time period when the receiver of the hearing device is turned off. Thus faster switching or handover between transmitter units is provided for.

Selecting secondary time offsets, e.g. selecting the first secondary time offset may be based on a predetermined offset scheme, a random offset scheme, or a pseudo-random offset scheme. Transmitting the secondary pilot package at times that are not fixed in respect to the audio block or primary pilot package further enhance the possibility of a hearing device searching for possible alternative transmitter units to receive a pilot package of a transmitter unit transmitting a desired audio stream.

It may be beneficial to wait for a certain time after transmitting the primary pilot package before transmitting the secondary pilot package to improve the chances of a hearing device being able to receive a pilot package. Thus, the time difference between a primary and a secondary pilot package, e.g. the time difference between the first primary pilot package and the first secondary pilot package, may be selected to be larger than a first time threshold. The first time threshold (Tdif,min) may be a percentage of the period length T. The first time threshold (Tdif,min) may be in the range from 0.05 T to 0.8 T, such as 0.20 T, 0.25 T, 0.30 T, 0.40 T, 0.50 T, 0.60 T or any ranges there between. In an exemplary method, the first time threshold (Tdif,min) is selected to be larger than 0.5 T. The first time threshold (Tdif,min) may be larger than the length of an audio block.

The first audio block may comprise a second primary audio package. The second primary audio package may comprise transmitter unit address.

Transmitting a first audio block may comprise transmitting a second primary audio package. The second primary audio package may comprise transmitter unit address of the first transmitter unit, i.e. the transmitter unit from where it was transmitted. Further, the first audio block may comprise secondary audio package(s) constituting a copy of the primary audio package(s), and allowing for recovering packages which have been dropped. First and second audio packages enables provision of audio data to the left and right ear respectively, thus providing transmission of audio in stereo. All audio packages (first, second, primary, secondary) transmitted from the first transmitter unit may comprise transmitter unit address of the first transmitter unit, i.e. the transmitter unit from which they were transmitted.

A pilot package may comprise an audio stream identifier. The audio stream identifier may be indicative of the audio track within the audio stream, allowing a hearing device receiving the pilot package to identify the audio track of the audio stream corresponding to the received pilot package. The audio stream identifier and/or a network identifier and/or other data indicative of a group of transmitter units in the pilot package may allow the hearing device to only consider switching to alternative transmitter units that transmits one of a group of specific audio streams, e.g. the same audio track as the hearing device is already receiving.

In an exemplary audio system, a plurality of audio streams comprising a number of different audio tracks may be transmitted. The hearing device may be provided with information of an audio stream from receiving the corresponding pilot package. When the hearing device wishes to switch to receiving from an alternative transmitter unit, the hearing device examines the audio stream identifiers comprised within the received pilot packages, the hearing device may thus ensure that switching is performed so as to receive the correct audio track from an alternative transmitter unit, i.e. the audio track which is already being received from the first transmitter unit.

The method may be utilized by transmitting an electromagnetic signal in accordance with the method as described.

The electromagnetic signal may comprise a plurality of audio blocks, including a first audio block in a first audio frame and a second audio block in a second audio frame following the first audio frame. Audio blocks of the electromagnetic signal, e.g. the first audio block and the second audio block, may each comprise one or more audio packages including a first primary audio package.

The electromagnetic signal comprises a first primary pilot package in the first audio frame. The first primary pilot package and the first primary audio package of the second audio block may be separated by a first primary time offset.

The first primary pilot package comprises transmitter unit address, the first primary time offset, and channel identifier of the first primary audio package of the second audio block.

The electromagnetic signal may comprise a first secondary pilot package in the first audio frame. The first secondary pilot package and the first primary audio package of the second audio block may be separated by a first secondary time offset. The first secondary pilot package may comprise transmitter unit address, the first secondary time offset, and channel identifier of the first primary audio package of the second audio block.

Transmission of an audio stream as described may be performed by a transmitter unit or an audio system comprising one or more transmitter units.

An exemplary audio system for transmitting wireless audio streams comprises a first transmitter unit configured for transmitting audio blocks. Each audio block includes one or more audio packages including a first primary audio package. The first primary audio package comprises transmitter unit address of the respective transmitter.

The first transmitter unit may be configured to transmit a first audio block in a first audio frame. The first audio block may comprise a first primary audio package, and the first primary audio package may comprise transmitter unit address of the first transmitter unit.

The first transmitter unit may further be configured to transmit a first primary pilot package. The first primary pilot package may comprise transmitter unit address of the first transmitter unit, a first primary time offset, and channel identifier of a first primary audio package of a second audio block in a second audio frame.

The first transmitter unit may further be configured to transmit the first primary audio package of the second audio block at a start time depending on the first primary time offset and the channel identifier.

The second audio block is thus transmitted from the first transmitter unit on a channel according to the channel identifier comprised within the first primary pilot package, and at a time in accordance with the first primary time offset comprised within the first primary pilot package. Thereby a hearing device receiving the first primary pilot package is able to receive the second audio block based on information in the primary pilot package.

The first primary time offset and primary time offsets in general may be fixed or randomly or pseudo-randomly selected. However, whether fixed or randomly or pseudo-randomly selected, the time of transmitting the second audio block is known when transmitting the first primary pilot package. In an exemplary method and audio system, the (first) primary pilot package follows directly after the audio block.

The first secondary time offset and secondary time offsets in general may be randomly or pseudo-randomly selected. However, whether fixed or randomly or pseudo-randomly selected, the time of transmitting the second audio block is known when transmitting the first secondary pilot package.

The audio system may comprise a second transmitter unit, wherein the second transmitter unit may be configured to transmit a first audio block in a first audio frame. The first audio block may comprise a first primary audio package, and the first primary audio package may comprise transmitter unit address of the second transmitter unit.

The second transmitter unit may further be configured to transmit a first primary pilot package. The first primary pilot package may comprise transmitter unit address of the second transmitter unit, a first primary time offset, and channel identifier of a first primary audio package of a second audio block in a second audio frame. The second transmitter unit may further be configured to transmit the first primary audio package of the second audio block at a start time depending on the first primary time offset and the channel identifier of the first primary pilot package from the second transmitter.

FIG. 1 schematically illustrates the functionality of an exemplary audio system 2. The audio system 2 is illustrated with a plurality of transmitter units 6 connected to a transmitter control unit 4. A user in a first position 50 wearing a hearing device (not shown), receives an audio stream from a first transmitter unit 7. When the user 50, moves to another position or area 50', the audio stream signal transmitted from the first transmitter unit 7 may become weak. The hearing device performs a search, which is facilitated by receiving pilot packages of available transmitter units 6. The hearing device identifies a second transmitter unit 7' transmitting the same audio track and hence change to continue the reception by receiving the audio stream from the second transmitter unit 7'.

Figure 2:
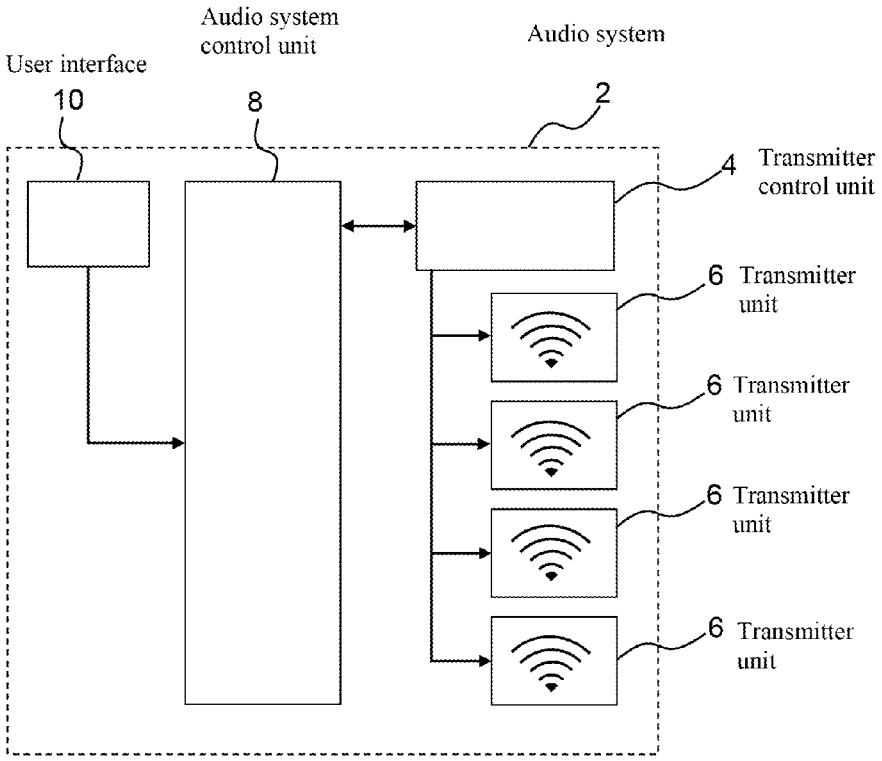
FIG. 2 schematically illustrates an exemplary audio system.

FIG. 2 schematically illustrates an exemplary audio system 2 in more detail. The audio system 2 comprises one or a plurality of transmitter units 6 as illustrated, a transmitter control unit 4, an audio system control unit 8 and a user interface 10. The transmitter units 6 stream audio data comprising audio packages and pilot packages according to the method described herein. The transmitter control unit 4 controls the transmitter units 6, e.g. controlling for each transmitter unit 6 which audio track to stream and operating parameters of the transmitter units. The audio system control unit 8 controls the transmitter units 6 via the transmitter control unit 4, in accordance with external inputs. External input may in the exemplary audio system 2 be provided by a user interface 10. The user interface may be accessed either by an operator or by a user.

Figure 3:
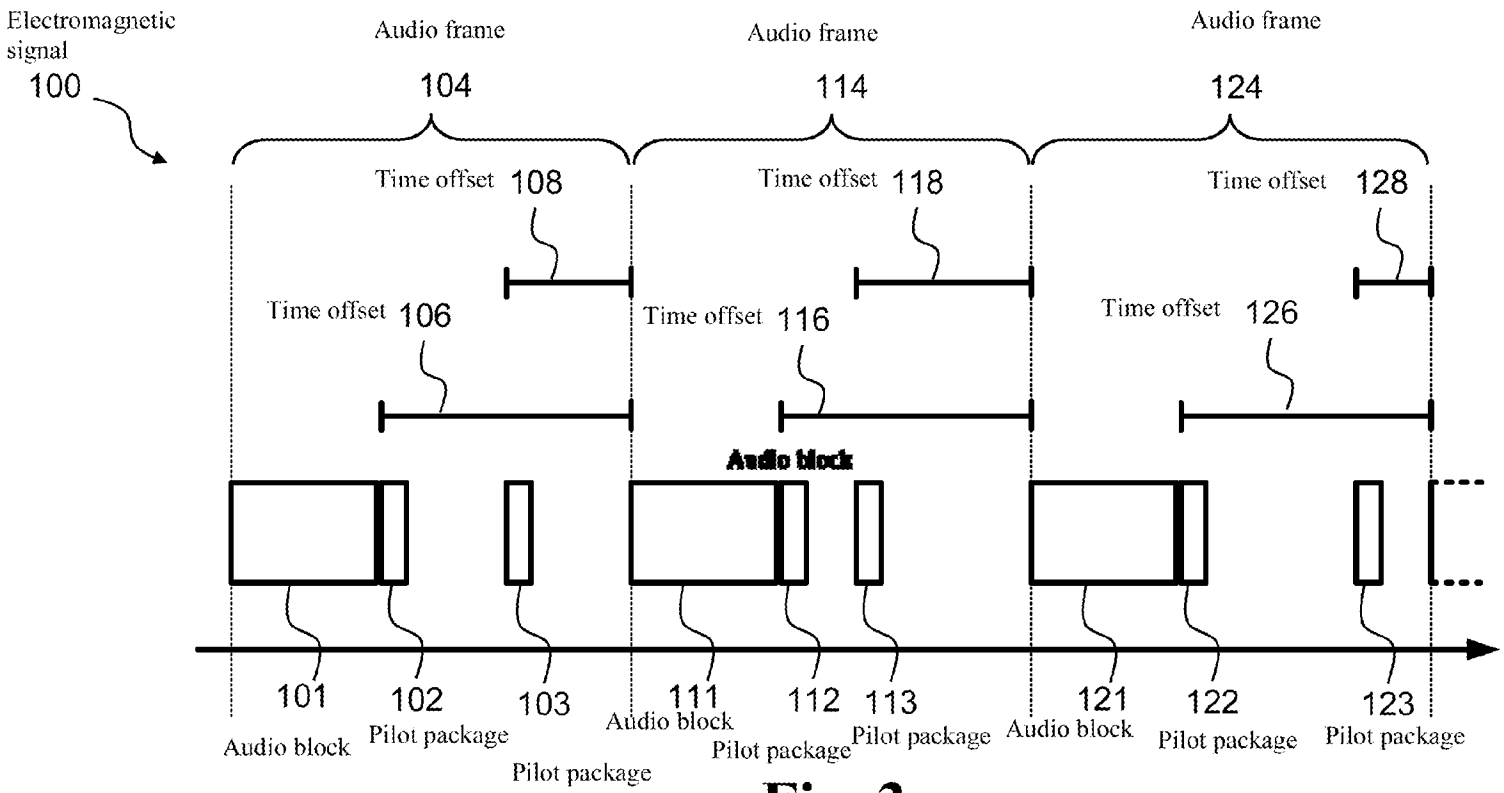
FIG. 3 schematically illustrates an exemplary electromagnetic signal.

FIG. 3 schematically illustrates an exemplary electromagnetic signal 100. The electromagnetic signal 100 may in an exemplary audio system be transmitted from any of the transmitter units 6 as shown in FIGS. 1 and 2. The electromagnetic signal 100 represents an audio stream and is divided into audio frames, whereof a first audio frame 104, a second audio frame 114, and a third audio frame 124 with a fixed period length of T=10 ms is illustrated. Each audio frame comprises an audio block 101, 111, 121, a primary pilot package 102, 112, 122, and optionally a secondary pilot package 103, 113, 123, respectively. The audio blocks 101, 111, 121 comprise at least a first primary audio package (not shown) and may in addition comprise any number of audio packages. The number of audio packages does not need to be the same for all audio blocks.

The first audio frame 104 starts by a first primary audio package of the first audio block 101 being transmitted. After transmitting the first primary audio block 101, a first primary pilot package 102 is transmitted, and optionally a first secondary pilot package 103 is transmitted.

The first primary pilot package 102 comprises information as to how (e.g. channel identifier of the first primary audio package of the second audio block) and when (e.g. first primary time offset 106) to receive the first primary audio package of the second audio block 111. The first primary pilot package 102 comprises a first primary time offset 106 indicating the time between transmittal of the first primary pilot package 102 and transmittal of the first primary audio package of the second audio block 111 of the second audio frame 114. The first primary pilot package is transmitted on a first primary pilot channel selected from a subset of three or more available channels according to a pseudo-random frequency hopping scheme.

The first secondary pilot package 103 comprises, as the first primary pilot package, information as to how and when to receive the first primary audio package of the second audio block 111. The first secondary pilot package 103 comprises a first secondary time offset 108 indicating the time between transmittal of the first secondary pilot package 103 and transmittal of the first primary audio package of the second audio block 111 of the second audio frame 114.

In an exemplary electromagnetic signal, the time duration T of an audio frame 104, 114, 124 is constant, and may e.g. be a time of between 2 ms and 20 ms, such as between 5 ms and 12 ms or such as between 6 ms and 10.2 ms, or between 6 ms and 6.5 ms, or between 7.2 ms and 7.7 ms, or between 9.8 ms and 10.2 ms.

The primary pilot packages 102, 112, 122 may be transmitted at a time within the respective audio frames resulting in that the primary time offsets 106, 116, 126 are fixed and equal for all audio frames 104, 114, 124. The secondary pilot packages 103, 113, 123 may be transmitted at a time selected randomly or pseudo-randomly, resulting in a random or pseudo random secondary time offset 108, 118, 128 between the respective secondary pilot packages and first primary audio packages of the following audio blocks.

Figure 4:
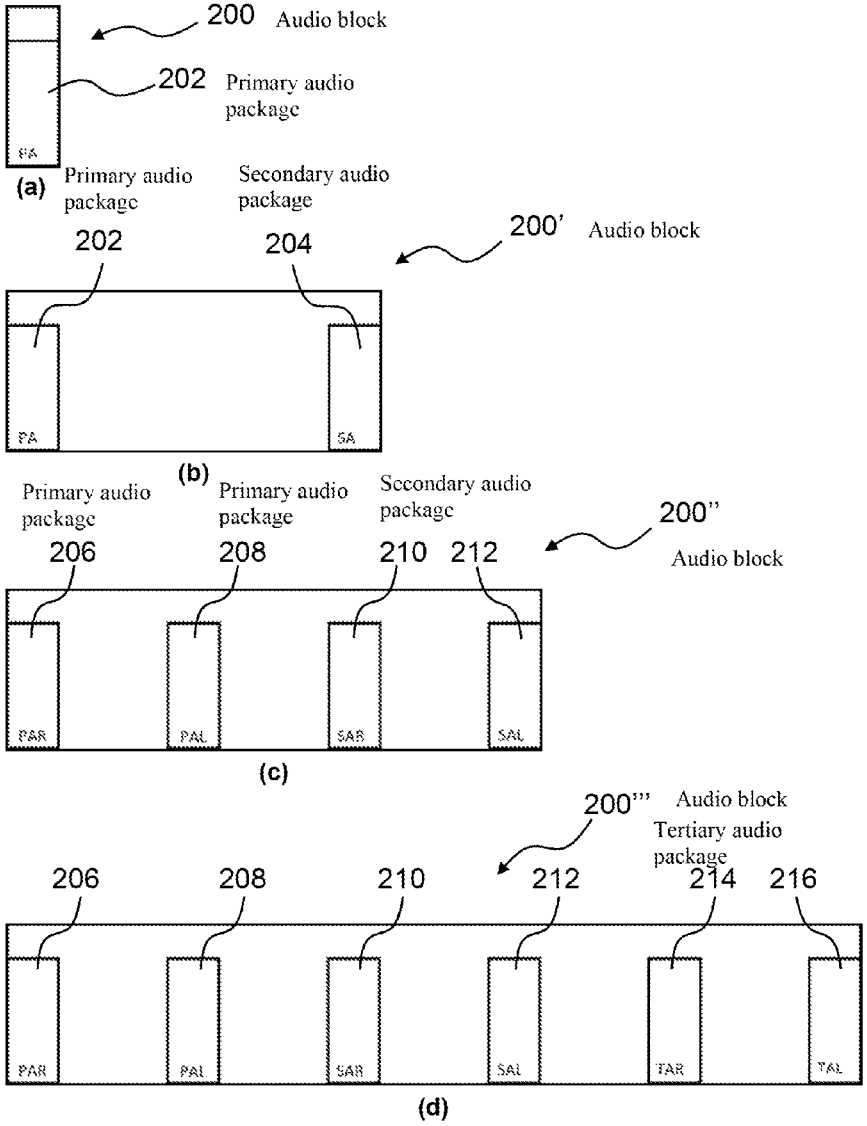
FIG. 4 schematically illustrates different audio blocks.

FIG. 4 (*a*) to (*d*) illustrate four different exemplary audio blocks 200, 200', 200", 200"'. FIG. 4(*a*) illustrates an audio block 200 comprising a primary audio package 202, e.g. a mono audio signal. FIG. 4(*b*) illustrates an audio block 200' of an exemplary mono signal comprising a primary audio package 202 and a secondary audio package 204. The secondary audio package 204 may be a copy of the primary audio package 202, to enhance chances of a successful reception of data in a hearing device. FIG. 4(*c*) illustrates an audio block 200" of an exemplary stereo signal. The audio block 200" in FIG. 4(*c*) comprises a first primary audio package 206 and a second primary audio package 208 for right and left ear, respectively. The audio block 200" illustrated in FIG. 4(*c*) further comprises a first secondary audio package 210 and a second secondary audio package 212. The first secondary audio package 210 may be a copy of the first primary audio package 206, and the second secondary audio package 212 may be a copy of the second primary audio package 208. FIG. 4(*d*) illustrates an audio block 200"' of an exemplary stereo signal. The audio block 200"' illustrated in FIG. 4*d* comprises a first tertiary audio package 214 and a second tertiary audio package 216. The first tertiary audio package 214 may be a copy of the first secondary right audio package 210 and/or the first primary audio package 206. The second tertiary audio package 216 may be a copy of the second secondary audio package 212 and/or the second primary audio package 208. A "copy of" means that at least the audio data of the audio packages are identical.

Figure 5:
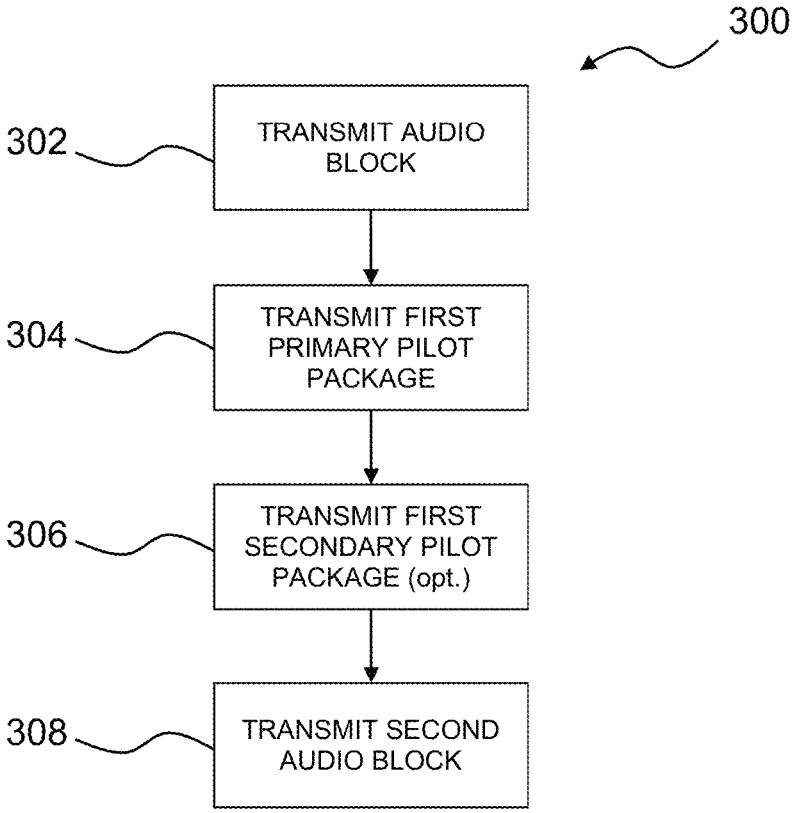
FIG. 5 is a flow diagram of an exemplary method according to some embodiments, FIG. 6 schematically illustrates an exemplary audio package, and FIG. 7 schematically illustrates an exemplary pilot package.

FIG. 5 is a flow diagram of an exemplary method 300 according to some embodiments. The method 300 comprises transmitting 302 a first audio block, transmitting 304 a first primary pilot package and transmitting 308 a second audio block. Optionally, the method 300 comprises transmitting 306 a first secondary pilot package after transmitting 304 the first primary pilot package and before transmitting 308 the second audio block in the second audio frame.

Transmitting 302 the first audio block comprises transmitting at least a first primary audio package comprising transmitter unit address of the transmitter unit from which it was transmitted.

Transmitting 304 the first primary pilot package comprises transmitting transmitter unit address of the transmitter unit from which it was transmitted, a first primary time offset, and a channel identifier of the first primary audio package of the second audio block in a second audio frame.

Optional transmittal 306 of a first secondary pilot package comprises transmitting a first secondary pilot package comprising transmitter unit address of the transmitter unit from which it was transmitted, a first secondary time offset, and a channel identifier of the first primary audio package of the second audio block in a second audio frame.

FIG. 6 illustrates an exemplary audio package comprising transmitter unit address, optional audio stream identifier, and audio stream data. Transmitter unit address may be indicative of the transmitter unit from which the audio package was transmitted. Audio stream identifier may comprise data indicative of the audio stream, e.g. audio track identification, audio group identification etc. Audio stream data comprises a finite part of the audible information forming the audio stream.

FIG. 7 illustrates an exemplary primary and/or secondary pilot package comprising transmitter unit address, channel identifier, time offset, optional audio stream identifier, and optional network identifier. Transmitter unit address may be indicative of the transmitter unit from which the pilot package was transmitted. Channel identifier may be indicative of the channel where the next audio block of the audio stream is transmitted, i.e. the channel identifier may be a frequency or a number indicating a frequency. Time offset may be indicative of when the next audio block is transmitted. Audio stream identifier may comprise data indicative of the audio stream, e.g. audio track identification, audio group identification etc. Network identifier may be indicative of a group of transmitter units, e.g. a network identifier may comprise a subnet address. The information comprised within a pilot package may enable the hearing device to receive the following audio block from the transmitter unit transmitting the audio stream in question by configuring the hearing device in accordance with the information.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2 audio system
4 transmitter control unit
6 transmitter unit
8 audio system control unit
10 audio system user interface
50, 50' user of a hearing device
100 electromagnetic signal
101 first audio block ($A_1$)
102 first primary pilot package ($P_{1,1}$)
103 first secondary pilot package ($P_{1,2}$)
104 first audio frame
106 first primary time offset ($\Delta t_{1,1}$)
108 first secondary time offset ($\Delta t_{1,2}$)
111 second audio block ($A_2$)
112 second primary pilot package ($P_{2,1}$)
113 second secondary pilot package ($P_{2,2}$)
114 second audio frame
116 second primary time offset ($\Delta t_{2,1}$)
118 second secondary time offset ($\Delta t_{2,2}$)
121 third audio block ($A_3$)
122 third primary pilot package ($P_{3,1}$)
123 third secondary pilot package ($P_{3,2}$)
124 third audio frame
126 third primary time offset ($\Delta t_m$)
128 third secondary time offset ($\Delta t_{3,2}$)
200, 200', 200", 200'" audio block
202 primary audio package
204 secondary audio package
206 first primary audio package
208 second primary audio package
210 first secondary audio package
212 second secondary audio package
214 first tertiary audio package
216 second tertiary audio package
300 method for transmitting
302 transmitting first audio block
304 transmitting first primary pilot package
306 transmitting first secondary pilot package
308 transmitting second audio block

The invention claimed is:

1. A method for transmitting wireless audio streams, the method performed by an audio system comprising a first transmitter unit, the method comprising:

transmitting a first audio block in a first audio frame, the first audio block comprising a first primary audio package having a transmitter unit address of the first transmitter unit;

transmitting a first primary pilot package, the first primary pilot package comprising the transmitter unit address of the first transmitter unit, a first primary time offset, and a channel identifier of a first primary audio package of a second audio block in a second audio frame; and transmitting the first primary audio package of the second audio block at a start time depending on the first primary time offset and the channel identifier.

2. The method according to claim 1, further comprising transmitting a first secondary pilot package, the first secondary pilot package comprising the transmitter unit address of the first transmitter unit, a first secondary time offset, and the channel identifier of the first primary audio package of the second audio block, the secondary time offset being indicative of a time offset between the first secondary pilot package and the first primary audio package of the second audio block.

3. The method according to claim 2, further comprising selecting the first secondary time offset based on a predetermined offset scheme, a random offset scheme, or a pseudo-random offset scheme.

4. The method according to claim 2, wherein a time difference between the first primary pilot package and the first secondary pilot package is larger than a first time threshold.

5. The method according to claim 1, wherein the first audio block further comprises a second primary audio package having the transmitter unit address of the first transmitter unit.

6. The method according to claim 1, wherein the first primary pilot package comprises an audio stream identifier.

7. A transmitter unit for transmitting wireless audio streams, the transmitter unit comprises a signal transmission device, wherein the transmitter unit is configured for transmitting an electromagnetic signal comprising a plurality of audio blocks including a first audio block in a first audio frame and a second audio block in a second audio frame following the first audio frame, each of the first audio block and the second audio block comprising a first primary audio package, the electromagnetic signal comprising a first primary pilot package in the first audio frame, wherein the first primary pilot package and the first primary audio package of the second audio block is separated by a first primary time offset, and wherein the first primary pilot package comprises a transmitter unit address, the first primary time offset, and a channel identifier of the first primary audio package of the second audio block.

8. The transmitter according to claim 7, wherein the electromagnetic signal comprises a first secondary pilot package in the first audio frame, the first secondary pilot package and the first primary audio package of the second audio block being separated by a first secondary time offset, wherein the first secondary pilot package comprises the transmitter unit address, the first secondary time offset, and the channel identifier of the first primary audio package of the second audio block.

9. The transmitter according to claim 8, wherein a time difference between the first primary pilot package and the first secondary pilot package is larger than a first time threshold.

10. The transmitter according to claim 7, wherein the first audio block comprises a second primary audio package having the transmitter unit address.

11. The transmitter according to claim 7, wherein the first primary pilot package comprises an audio stream identifier.

12. An audio system for transmitting wireless audio streams, the audio system comprising one or more transmitter units including a first transmitter unit, the one or more transmitter units being configured for transmitting audio blocks, each of at least two of the audio blocks including a first primary audio package comprising a transmitter unit address, wherein the first transmitter unit is configured to transmit a first audio block in a first audio frame, the first audio block comprising a first primary audio package comprising a transmitter unit address of the first transmitter unit;

transmit a first primary pilot package, the first primary pilot package comprising the transmitter unit address of the first transmitter unit, a first primary time offset, and a channel identifier of a first primary audio package of a second audio block in a second audio frame; and transmit the first primary audio package of the second audio block at a start time depending on the first primary time offset and the channel identifier of the first primary audio package of the second audio block.

13. The audio system according to claim 12, wherein the one or more transmitter units comprise a second transmitter unit, and wherein the second transmitter unit is configured to transmit a first audio block in a first audio frame, the first audio block transmitted by the second transmitter unit comprising a first primary audio package having a transmitter unit address of the second transmitter unit;

transmit a first primary pilot package, the first primary pilot package transmitted by the second transmitter unit comprising the transmitter unit address of the second transmitter unit, a first primary time offset, and a channel identifier of a first primary audio package of a second audio block in a second audio frame; and transmit the first primary audio package of the second audio block from the second transmitter at a start time depending on the first primary time offset and the channel identifier of the first primary audio package of the second audio block from the second transmitter.

14. An audio system for transmitting wireless audio streams, the audio system comprising a first transmitter unit configured for transmitting audio blocks, wherein the first transmitter unit is configured to:

transmit a first audio block in a first audio frame, the first audio block comprising a first primary audio package having a transmitter unit address of the first transmitter unit;

transmit a first primary pilot package, the first primary pilot package comprising the transmitter unit address of the first transmitter unit, a first primary time offset, and a channel identifier of a first primary audio package of a second audio block in a second audio frame; and transmit the first primary audio package of the second audio block at a start time depending on the first primary time offset and the channel identifier.

15. The system according to claim 14, wherein the first transmitter is further configured to transmit a first secondary pilot package, the first secondary pilot package comprising the transmitter unit address of the first transmitter unit, a first secondary time offset, and the channel identifier of the first primary audio package of the second audio block, the secondary time offset being indicative of a time offset between the first secondary pilot package and the first primary audio package of the second audio block.

16. The system according to claim 15, wherein the system is configured for selecting the first secondary time offset based on a predetermined offset scheme, a random offset scheme, or a pseudo-random offset scheme.

17. The system according to claim 15, wherein a time difference between the first primary pilot package and the first secondary pilot package is larger than a first time threshold.

18. The system according to claim 14, wherein the first audio block further comprises a second primary audio package having the transmitter unit address of the first transmitter unit.

19. The system according to claim 14, wherein the first primary pilot package comprises an audio stream identifier.

* * * * *